US007528558B2

(12) United States Patent
Yu et al.

(10) Patent No.: US 7,528,558 B2
(45) Date of Patent: May 5, 2009

(54) BALLAST WITH IGNITION VOLTAGE CONTROL

(75) Inventors: Qinghong Yu, Reading, MA (US); Joseph L. Parisella, Beverly, MA (US)

(73) Assignee: Osram Sylvania, Inc., Danvers, MA (US)

( * ) Notice: Subject to any disclaimer, the term of this patent is extended or adjusted under 35 U.S.C. 154(b) by 89 days.

(21) Appl. No.: 11/747,298

(22) Filed: May 11, 2007

(65) Prior Publication Data

US 2008/0278088 A1 Nov. 13, 2008

(51) Int. Cl.
*H05B 37/02* (2006.01)

(52) U.S. Cl. ..... 315/308; 315/209 R; 315/225

(58) Field of Classification Search ..... 315/209 R, 315/224–226, 246–247, 291, 307–309, 312, 315/360, DIG. 7
See application file for complete search history.

(56) References Cited

U.S. PATENT DOCUMENTS 5,751,115 A * 5/1998 Jayaraman et al. ..... 315/225
2003/0222594 A1* 12/2003 Mita ..... 315/224
2006/0049777 A1* 3/2006 Kumagai et al. ..... 315/224
2006/0181226 A1* 8/2006 Rudolph ..... 315/291
2008/0136343 A1* 6/2008 Yu et al. ..... 315/219

* cited by examiner

*Primary Examiner*—David Hung Vu
*Assistant Examiner*—Tung X Le
(74) *Attorney, Agent, or Firm*—Fitch, Even, Tabin & Flannery

(57) ABSTRACT

A ballast (10) for powering a lamp load (70) comprising one or more gas discharge lamps (72,74) includes an inverter (200), a resonant output circuit (400), and a control circuit (600). During operation of ballast (10), control circuit (600) monitors at least one voltage within one or more series resonant circuits of output circuit (400). When the monitored voltage reaches a specified level, control circuit (600) directs inverter (200) to maintain its operating frequency at a present value for a predetermined period of time, so as to allow output circuit (400) to provide a suitably high voltage for igniting the lamp(s). If the lamp(s) ignite within the predetermined period of time, control circuit (600) ceases controlling inverter (200) to maintain its operating frequency at the present value, so as to allow for normal operation of the lamp(s). Control circuit (600) also provides a lamp stabilization function, in which the inverter operating frequency is prevented from falling below a specified minimum value, and a protective function, in which inverter (200) is deactivated in response to failure of the lamp(s) to ignite within the predetermined period of time.

30 Claims, 3 Drawing Sheets

BALLAST WITH IGNITION VOLTAGE CONTROL

FIELD OF THE INVENTION

The present invention relates to the general subject of circuits for powering discharge lamps. More particularly, the present invention relates to a ballast that includes circuitry for controlling ignition voltage(s) provided to one or more gas discharge lamps.

BACKGROUND OF THE INVENTION

Electronic ballasts for powering gas discharge lamps are generally classified into two groups, according to the operating mode by which the lamps are ignited and powered. In preheat type ballasts (which include so-called "rapid start" and "program start" ballasts), the lamp filaments are initially preheated prior to application of high voltage (e.g., 350 volts rms) for igniting the lamps. In instant start type ballasts, by contrast, the filaments are not preheated; consequently, for instant start type ballasts, a much higher voltage (e.g., 600 volts rms) is required in order to properly ignite the lamps.

For instant start type ballasts, a common circuit topology includes a current-fed driven inverter (of either a push-pull type or a half-bridge type) and a parallel resonant output circuit; the parallel resonant output circuit commonly includes an output transformer for providing, among other things, an electrically isolated output. While this topology has been widely and successfully employed in ballasts for powering certain common types of lamps, such as standard T8 type lamps, it has proven to be considerably less than ideal (from the standpoint of physical size, material cost, and/or electric efficiency) for certain other types of lamps, such as 54 watt T5 HO lamps.

An alternative circuit topology employs an output circuit that includes one or more series resonant circuits, in which a separate series resonant circuit is utilized for each of the lamps that are powered by the ballast. For instant start applications, wherein the ignition voltage must be very high in order to properly and reliably ignite the lamp(s), this topology presents certain challenges, the most pertinent of which stem from the fact the magnitude of the ignition voltage is dependent upon the relationship between two main quantities: (i) the operating frequency of the inverter; and (ii) the resonant frequency/frequencies of the series resonant circuit(s).

In many existing ballasts, the operating frequency of the inverter is typically set at or near the nominal resonant frequency/frequencies of the resonant output circuit(s). In practice, unfortunately, the effective resonant frequency/frequencies of the resonant output circuit(s) are subject to variation due to a number of factors. This variation may substantially interfere with the goal of generating suitably high voltage(s) for properly igniting the lamp(s).

As is known to those skilled in the art, the effective resonant frequency of a series resonant circuit is dependent upon certain parameters, including the inductance of the resonant inductor and the capacitance of the resonant capacitor. In practice, those parameters are subject to component tolerances, and may vary by a considerable amount. Additionally, the effective resonant frequency of a series resonant circuit is also influenced by the lead lengths and/or the nature of the electrical wiring that connects the ballast to the lamp(s); the electrical wiring introduces parasitic capacitances which effectively alter the effective natural resonant frequency of the series resonant circuit(s) within the output circuit, and which therefore affect the magnitude of the ignition voltage (s) provided by the ballast to the lamp(s). Such parameter variation makes it difficult and/or impractical to pre-specify (i.e., on a priori basis) the operating frequency of the inverter so as to ensure that a suitably high ignition voltage is provided to the lamp(s).

As will be explained in further detailed herein, the aforementioned difficulties arising from parameter variation are even more problematic when a resonant output circuit includes multiple resonant circuits and/or when the wiring between the ballast output connections and the lamp(s) has a considerable length; in the latter case, the resulting parasitic capacitance becomes a very significant factor. Accordingly, for a given predefined inverter operating frequency, the magnitude of the ignition voltage that is provided by a series resonant circuit may vary considerably, and may, in some instances, be insufficient or at least considerably less than ideal, for igniting the lamp(s) in a desired manner.

In an effort to address the aforementioned problems, the prior art includes several approaches, such as those which are disclosed in U.S. Pat. Nos. 5,680,015 and 5,925,990, in which the inverter operating frequency is adjusted in an attempt to ensure that sufficient ignition voltage is provided. While the approaches disclosed in those patents appear to represent useful advances in the art, those approaches have the disadvantage of requiring complicated control circuits that are materially expensive and that appear to operate in a manner that may negatively impact the energy efficiency of the ballast.

Accordingly, a need exists for a ballast with a control circuit for ensuring that an appropriate ignition voltage is provided for igniting one or more lamps, and that may be implemented within existing ballasts in an economical and energy efficient manner. Such a ballast would represent a considerable advance over the prior art.

DETAILED DESCRIPTION OF THE PREFERRED EMBODIMENTS

Figure 1:
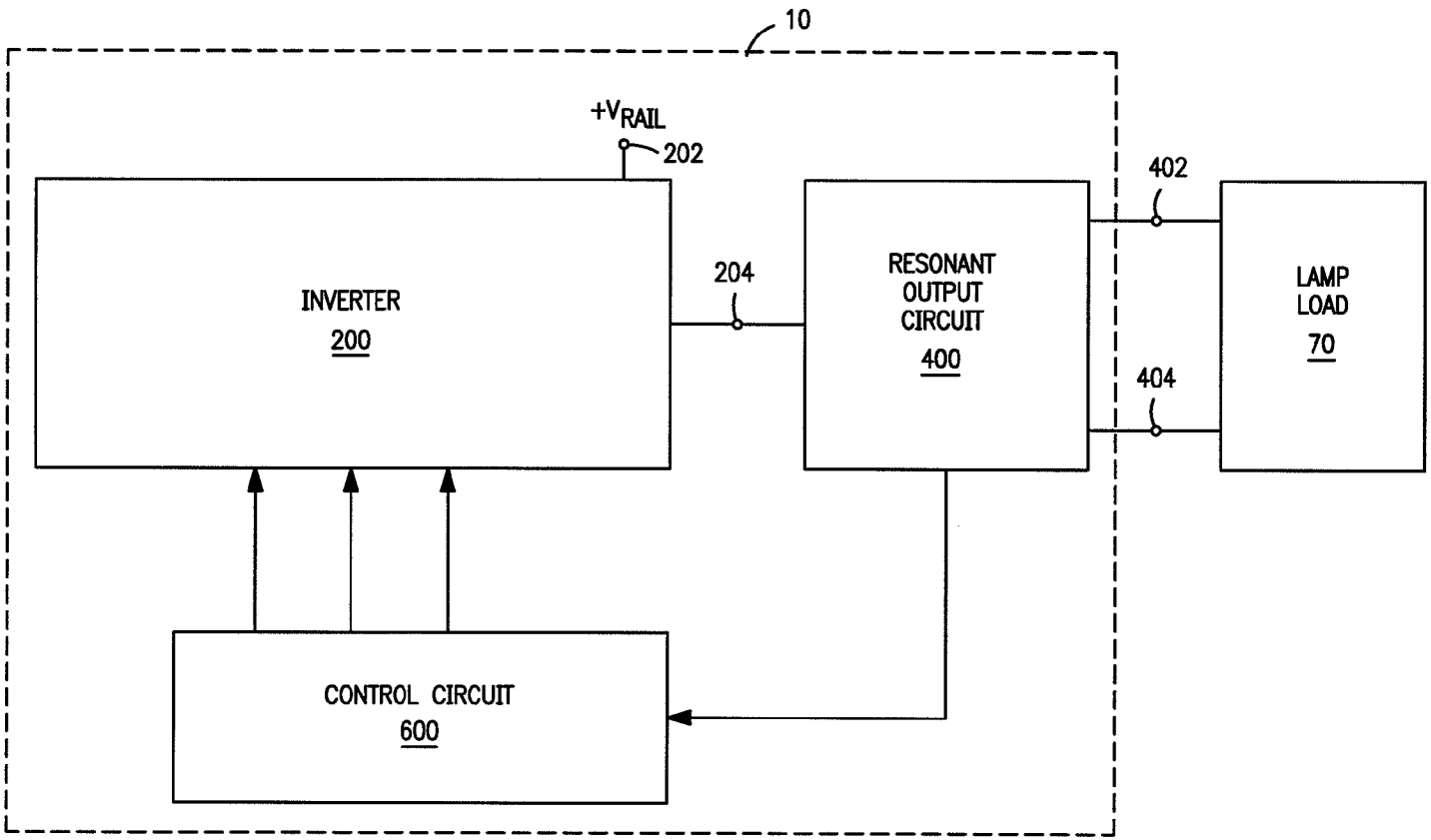
FIG. 1 is a block electrical diagram of a ballast for powering one or more gas discharge lamps, in accordance with the preferred embodiments of the present invention.

FIG. 1 describes a ballast 10 for powering a lamp load 70 that includes at least one gas discharge lamp. Ballast 10 comprises an inverter 200, a resonant output circuit 400, and a control circuit 600.

Inverter 200 includes an input 202 and an inverter output terminal 204. During operation, inverter 200 receives, via input 202, a substantially direct current (DC) voltage, $V_{RAIL}$. $V_{RAIL}$ is typically provided by suitable rectification circuitry (e.g., a combination of a full-wave bridge rectifier and a power factor correcting DC-to-DC converter, such as a boost converter) which receives power from conventional alternating current (AC) voltage source (e.g., 120 volts rms or 277 volts rms, at 60 hertz). During operation, inverter 200 provides, at inverter output terminal 204 (and taken with respect to a circuit ground), an inverter output voltage having an operating frequency that is typically selected to be greater than about 20,000 hertz.

Resonant output circuit 400 is coupled between inverter output terminal 202 and lamp load 70. Resonant output circuit 400 includes at least two output connections 402,404 adapted for coupling to lamp load 70. During operation, resonant output circuit 400 provides an ignition voltage for igniting, and a magnitude-limited current for operating, one or more lamps within lamp load 70.

Control circuit 600 is coupled to inverter 200 and resonant output circuit 400. During operation, control circuit 600 monitors a voltage within resonant output circuit 400. In response to the monitored voltage reaching a specified level, indicating that the ignition voltage (e.g., the voltage between output connections 402,404 prior to lamp ignition) has a magnitude that is sufficient for properly igniting the lamp(s), control circuit 600 directs inverter 200 to maintain its operating frequency at a present value for a predetermined period of time. By maintaining the operating frequency at its present value, control circuit 600 allows resonant output circuit 400 to maintain, for the predetermined period of time, the ignition voltage at a suitable level for igniting the lamp(s) within lamp load 70. If the lamp(s) ignite within the predetermined period of time, control circuit 600 ceases controlling inverter 200 to maintain its operating frequency at the present value; that is, control circuit 600 allows the operating frequency to decrease below the present value. Conversely, if the lamp(s) fail to ignite within the predetermined period of time, control circuit 600 deactivates inverter 200.

Control circuit 600 additionally provides a lamp stabilization period, following ignition of the lamp(s), during which control circuit 600 prevents the operating frequency of inverter 200 from falling below a specified minimum value. By preventing the operating frequency from falling below of a specified minimum value, control circuit 600 prevents inverter 200 from operating in a so-called "capacitive switching mode," which may be accompanied by undesirably high, and potentially destructive, levels of voltage, current, and/or power dissipation in inverter transistors 210,222.

Figure 2:
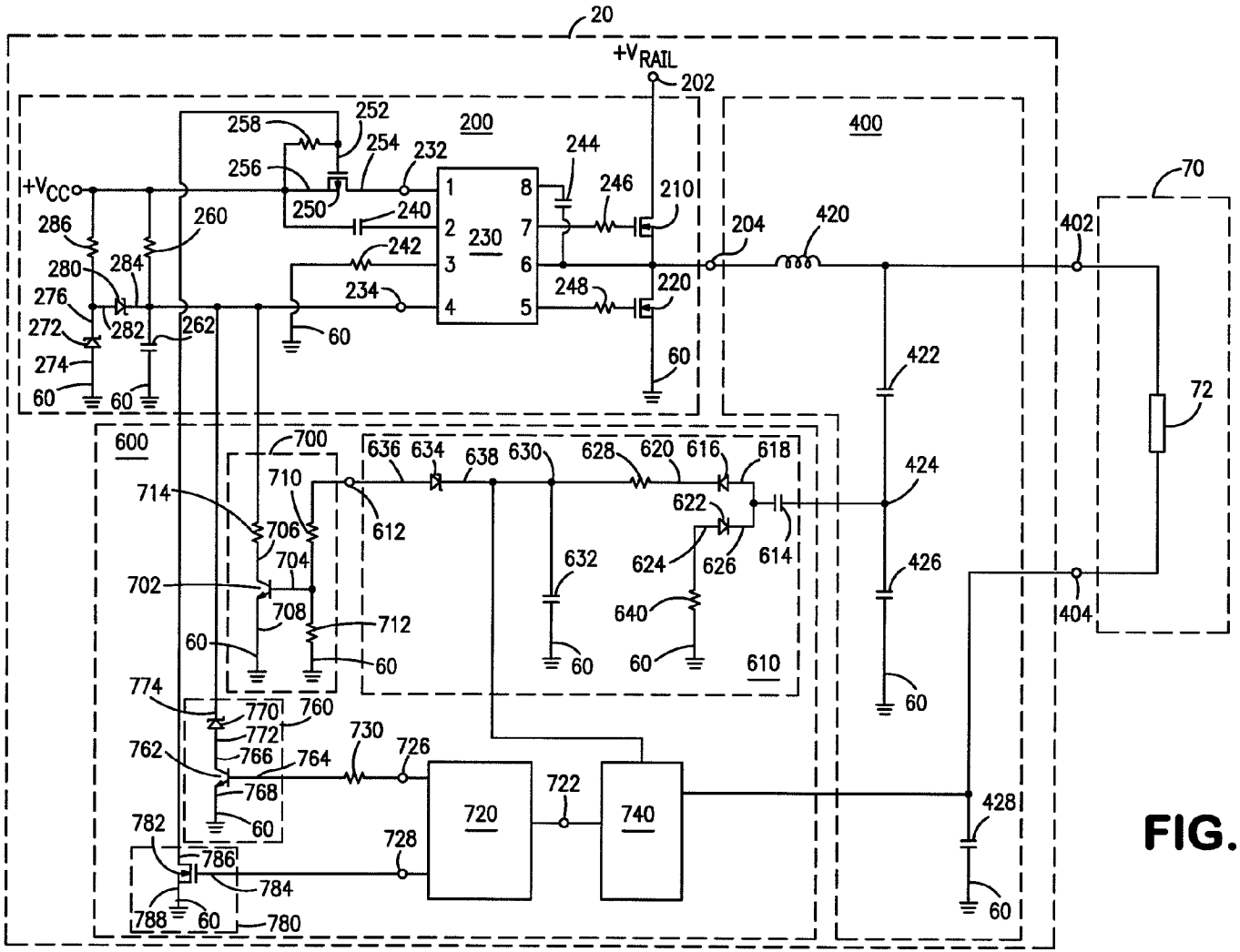
FIG. 2 is an electrical diagram of a ballast for powering one gas discharge lamp, in accordance with a first preferred embodiment of the present invention.

FIG. 2 describes a first preferred embodiment of ballast 10 (hereinafter referred to as ballast 20) for powering a single gas discharge lamp 72 in an instant start mode of operation.

Referring to FIG. 2, output circuit 400 is preferably realized as a parallel-loaded series-resonant type output circuit that includes first and second output connections 402,404, a resonant inductor 420, a resonant capacitor 422, a voltage divider capacitor 426, and a direct current (DC) blocking capacitor 428. First and second output connections 402,404 are adapted for coupling to lamp 72. Resonant inductor 420 is coupled between inverter output terminal 204 and first output connection 402. Resonant capacitor 422 is coupled between first output connection 402 and a first node 424. Voltage divider capacitor 426 is coupled between first node 424 and circuit ground 60. DC blocking capacitor 428 is coupled between second output connection 404 and circuit ground 60. During operation of ballast 20, output circuit 400 receives the inverter output voltage (via inverter output terminal 204) and provides (via output connections 402,404) a high voltage for igniting, and a magnitude-limited current for operating, lamp 72. For instance, if lamp 72 is realized as a T8 type lamp, the high voltage for igniting lamp 72 is typically selected to be on the order of about 600 volts rms, and the magnitude-limited operating current is typically selected to be on the order of about 180 milliamperes.

As illustrated in FIG. 2, inverter 200 is preferably realized as a driven half-bridge type inverter that includes input 202, inverter output terminal 204, first and second inverter switches 210,220, and an inverter driver circuit 230. As previously recited, input 202 is adapted for receiving a source of substantially DC voltage, $V_{RAIL}$. First and second inverter switches 210,220 are preferably realized by N-channel field-effect transistors (FETs). Inverter driver circuit 230 is coupled to inverter FETs 210,220, and may be realized by any of a number of available devices; preferably, inverter driver circuit 230 is realized by a suitable integrated circuit (IC) device, such as the IR2520 high-side driver IC manufactured by International Rectifier, Inc.

During operation of ballast 20, inverter driver circuit 230 commutates inverter FETs 210,220 in a substantially complementary manner (i.e., such that when FET 210 is on, FET 220 is off, and vice-versa) to provide a substantially squarewave voltage between inverter output terminal 204 and circuit ground 60. Inverter driver circuit 230 includes a DC supply input 232 (pin 1 of 230) and a voltage controlled oscillator (VCO) input 234 (pin 4 of 230). DC supply input 232 receives operating current (i.e., for powering inverter driver circuit 230) from a DC voltage supply, $+V_{CC}$, that is typically selected to provided a voltage that is on the order of about +15 volts or so. The operating frequency of inverter 200 is set in dependence upon a voltage provided to VCO input 234. More specifically, the instantaneous voltage that is present at VCO input 234 determines the instantaneous frequency at which inverter driver circuit 230 commutates inverter transistors 210,220; in particular, the frequency decreases as the voltage at VCO input 234 increases. It will be understood by those skilled in the art that the instantaneous frequency at which inverter driver circuit 230 commutates inverter transistors 210,220 is the same as the fundamental frequency (referred to herein as the "operating frequency") of the inverter output voltage provided between inverter output terminal 204 and circuit ground 60. Other components associated with inverter driver circuit 230 include capacitors 240,244 and resistors 242,246,248, the functions of which are known to those skilled in the art.

Advantageously, ballast 20 resolves the aforementioned difficulties (as discussed in the "Background of the Invention") by actively monitoring the voltage at first node 424, and selecting an operating frequency for inverter 200 that ensures that sufficient voltage is provided (between output connections 402,404) for properly igniting lamp 72 . It will be appreciated that the voltage at first node 424 is representative of the voltage that is provided between output connections 402,404, and is thus indicative of whether or not an appropriately high voltage is being provided for properly igniting lamp 72. As previously recited, control circuit 600 allows the inverter operating frequency to decrease until at least such time as the monitored voltage (at first node 424) reaches a specified level. Once that occurs, control circuit 600 maintains the operating frequency at its present level (thereby maintaining the ignition voltage between output connections 402,404 at a sufficiently high level) for a predetermined period of time, so as to give lamp 72 a chance to ignite. In this way, ballast 20 automatically compensates for parameter variations within output circuit 400 (due to variations in the values of the resonant circuit components or due to parasitic capacitances attributable to the wiring between the ballast output connections 402,404 and lamp 72), and thus ensures that a suitably high voltage is provided for properly and reliably igniting lamp 72.

Preferred circuitry for implementing inverter 200 and control circuit 600 is now described with reference to FIG. 2 as follows.

As depicted in FIG. 2, inverter 200 includes a supply switch 250. Supply switch 250 is preferably realized as P-channel FET having a gate 252, a source 254, and a drain 256. Source 254 is coupled to DC supply input 232 of inverter driver circuit 230. Drain 256 is coupled to DC voltage supply, $+V_{CC}$. Resistor 258, which functions to provide biasing of FET 250, is coupled between drain 256 and gate 252. During operation of inverter 200, inverter driver circuit 230 is activated when FET 250 is turned on, and is deactivated when FET 250 is turned off. Normally, FET 250 is turned on. However, as will be explained in further detail herein, in the event of a lamp fault condition, FET 250 is turned off by an appropriate control signal from control circuit 600.

Referring again to FIG. 2, inverter 200 further includes a frequency initializing circuit 270 comprising a zener diode 272, a diode 280, and a resistance 286. Zener diode 272 has an anode 274 and a cathode 276; anode 272 is coupled to circuit ground 60. Diode 280 has an anode 282 coupled to the cathode 276 of zener diode 272, and a cathode 284 coupled to VCO input 234 of inverter driver circuit 230. Resistance 286 is coupled between DC voltage supply, $+V_{CC}$, and cathode 276 of zener diode 272. During operation, frequency initializing circuit 270 operates to ensure that, following activation of inverter driver circuit 230 (which occurs following application of power to ballast 20), the voltage provided at VCO input 234 quickly reaches a level that corresponds to the inverter operating frequency being close to the natural resonant frequency of resonant output circuit 400. The functionality provided by frequency initializing circuit 270 is important, as it ensures that ballast 20 is capable, in compliance with applicable regulatory requirements concerning instant start operation, of igniting lamp 72 within a sufficiently short period of time (e.g., 1 millisecond or so, to provide, e.g., a peak voltage about 2000 volts in the case of two 54 watt T5 HO lamps connected in series) following application of power to ballast.

In a preferred embodiment, as illustrated in FIG. 2, control circuit 600 includes a voltage detection circuit 610 and a frequency-hold circuit 700. Preferred structures for realizing voltage detection circuit 610 and frequency-hold circuit 700, as well as various operational details of those circuits, are described as follows.

Voltage detection circuit 610 is coupled to resonant output circuit 400, and includes a detection output 612. During operation, voltage detection circuit 610 serves to provide a detection signal at detection output 612 in response to the monitored voltage (i.e., the voltage across capacitor 426) reaching the specified level. As previously explained, the monitored voltage is simply a scaled-down version of the voltage between output connections 402,404. Thus, the monitored voltage being at the specified level corresponds to the ignition voltage (provided between output connections 402, 404) being at a desired level (e.g., 600 volts rms) for igniting lamp 72.

In the first preferred embodiment, as described in FIG. 2, voltage detection circuit 610 comprises a first diode 616, a second diode 622, a coupling capacitor 614, a low-pass filter comprising a series combination of a filter resistor 628 and a filter capacitor 632, and a zener diode 634. First diode 616 has an anode 618 and a cathode 620. Second diode 622 has an anode 624 and a cathode 626. Anode 618 of first diode 616 is coupled to cathode 626 of second diode 622. Anode 624 of second diode 622 is operably coupled to circuit ground 60; preferably, and as illustrated in FIG. 2, anode 624 is coupled to circuit ground 60 by way of a resistor 640 which serves to limit the peak current that may flow through second diode 622. Coupling capacitor 614 is coupled between resonant output circuit 400 (i.e., to node 424) and anode 618 of first diode 616. Filter resistor 628 is coupled between cathode 620 of first diode 616 and a node 630 that is situated at a junction between filter resistor 628 and filter capacitor 632. Filter capacitor 632 is coupled between node 630 and circuit ground 60. Cathode 638 of zener diode 634 is coupled to node 630. Anode 636 of zener diode 634 is coupled to detection output 612.

During operation of voltage detection circuit 610, the voltage that develops across filter capacitor 632 is a scaled-down and filtered version of the positive half-cycles of the voltage at node 424. Coupling capacitor 614 serves to attenuate, while filter resistor 628 and filter capacitor 632 serve to suppress any high frequency components present in, the monitored voltage. When the voltage at node 630 reaches the zener breakdown voltage of zener diode 634, zener diode 634 becomes conductive and provides, at detection output 612, a voltage signal which indicates that the voltage at first node 424 (i.e., the voltage across voltage-divider capacitor 426) has reached the specified level.

Frequency-hold circuit 700 is coupled between detection output 612 of voltage detection circuit 610 and VCO input 234 of inverter driver circuit 230. During operation, and in response to the detection signal being present at detection output 612 (thereby indicating that the ignition voltage has attained a sufficiently high level), frequency-hold circuit 700 substantially maintains the voltage provided to VCO input 234 at a present level for the predetermined period of time (i.e., for the ignition period). By maintaining the voltage at VCO input 234 at its present level, the operating frequency of inverter 200 is correspondingly maintained at or near the effective natural resonant frequency of resonant output circuit 400 (accounting for any parameter variations due to component tolerances or wiring capacitances), thereby maintaining a suitably high ignition voltage for properly igniting lamp 72.

As described in FIG. 2, frequency-hold circuit 700 preferably comprises an electronic switch 702, a first biasing resistor 710, a second biasing resistor 712, and a pull-down resistor 714. Electronic switch 702 is preferably realized by a NPN type bipolar junction transistor (BJT) having a base 704, an emitter 708, and a collector 706. Emitter 708 of BJT 702 is coupled to circuit ground 60. First biasing resistor 710 is coupled between detection output 612 and base 704 of BJT 702. Second biasing resistor 712 is coupled between base 704 of BJT 702 and circuit ground 60. Pull-down resistor 714 is coupled between VCO input 234 of inverter driver circuit 230 and collector 706 of BJT 702.

During operation of ballast 20, frequency-hold circuit 700 is activated (i.e., transistor 702 is turned on) when the voltage signal at detection output 612 indicates that the monitored voltage has reached the specified level. With transistor 702 turned on, VCO input 234 of inverter driver circuit 230 is essentially coupled to circuit ground 60 via pull-down resistor 706 so as to momentarily prevent any further increase in the voltage at VCO input 234. Consequently, the voltage at VCO input 234 is essentially maintained at its present value (thereby causing the inverter operating frequency to be essentially maintained at its present value) for as long as transistor 702 remains turned on.

Once lamp 72 ignites and begins to conduct current, the monitored voltage substantially decreases from its previous level (i.e., from the specified level, as required for proper lamp ignition) by virtue of the "loading" effect that an ignited/operating lamp exerts upon the voltage response of resonant output circuit 400. At that point in time, the voltage signal at detection output 612 reverts to a level that is insufficient to maintain conduction of transistor 702; consequently, transistor 702 turns off. With transistor 702 turned off, the voltage at VCO input 234 is allowed to increase, thereby decreasing the operating frequency of inverter 200. However, as will be described in further detail herein, control circuit 600 preferably includes a lamp stabilization circuit 760 that functions to prevent the operating frequency of inverter 200 from decreasing to a level that may detract from the efficiency and/or reliability of inverter 200 and ballast 20.

Preferably, and as described in FIG. 2, control circuit 600 further comprises a microcontroller 720, a lamp status detection circuit 740, a lamp stabilization circuit 760, and an enable circuit 780. Preferred structures and/or pertinent operational details regarding microcontroller 720, lamp status detection circuit 740, lamp stabilization circuit 760, and enable circuit 780 are now described with reference to FIG. 2 as follows.

Microcontroller includes a first input 722, a first output 726, and a second output 728. First input 722 is coupled to lamp status detection circuit 740. First output 726 is coupled to lamp stabilization circuit 760. Second output 728 is coupled to the enable circuit 780. Microcontroller 720 is preferably realized by a suitable programmable integrated circuit, such as Part No. PIC10F510 (manufactured by Microchip, Inc.), which has the advantages of relatively low cost and low operating power requirements.

During operation, microcontroller 720 serves to control, according to internal timing functions (which are programmed into microcontroller 720) and in response to signals from lamp status detection circuit 740, the timing and activation of lamp stabilization circuit 760 and enable circuit 780. More particularly, microcontroller 720 activates lamp stabilization circuit 760 following ignition of lamp 72, and deactivates enable circuit 780 in response to occurrence of a lamp fault condition. The time durations for which lamp stabilization circuit 760 is activated and/or for which enable circuit 780 is deactivated are selected based upon desired design specifications and may be readily programmed into microcontroller 720.

For an instant start application, as described in FIG. 2, each end of lamp 72 has only one connection to ballast 20. More specifically, and in contrast with preheat type applications (e.g., rapid start or program start), the filaments of lamp 72 cannot be used to determine if lamp 72 is present and properly coupled to output connections 402,404. Consequently, in ballast 20, the presence of a functional lamp 72 is detected by monitoring two quantities: (i) the voltage at node 630 (which, after ignition of lamp 72, decreases to reflects the "loading effect" due to the ignited lamp); and (ii) the voltage across DC blocking capacitor 428 (i.e., if lamp 72 is not connected or is not operating in a substantially normal manner, the voltage across DC blocking capacitor 428 is prevented from attaining its normal operating value of about one half of $+V_{RAIL}$).

As previously discussed, an instant start ballast must be capable of providing a very high ignition voltage in order to properly and quickly ignite lamp 72. However, applicable industry standards require, for safety reasons, that if lamp 72 is not connected to the fixture sockets, then this high ignition must not be present (between output connections 402,404) for more than a limited period of time. Consequently, the timing of the ignition period (i.e., previously referred to herein as the "predetermined period of time") must be controlled in a precise manner.

For example, consider an application in which lamp 72 consists of two 54 watt T5 HO lamps that are connected in series between output connections 402,404. For that application, a peak output voltage of about 2000 volts must be sustained for about one millisecond in order to properly ignite the lamps and allow ballast 20 to observe (via lamp status detection circuit 740) the "loading effect" that occurs following proper ignition of the lamps. Additionally, the voltage across DC blocking capacitor 428 is monitored (via lamp status detection circuit 740) in order to confirm that functional lamps are present and properly coupled to output connections 402,404 (failing which, inverter 200 must be deactivated or operated in a reduced power mode in order to protect ballast 20 from damage, etc.). These functions, by their very nature, dictate a need for tightly controlled timing. That tightly controlled timing is most effectively and economically provided by microcontroller 720.

Moreover, in order to meet applicable standards for instant start applications, the operating frequency of inverter 200 must be quickly reduced (within one millisecond after power is applied to ballast 20) so as to generate a sufficiently high ignition voltage; correspondingly, capacitor 262 is selected to have a relatively low value (e.g., 22 nanofarads or so). For about 100 milliseconds or so after the ignition voltage is first provided between output connections 402,404, the inverter operating frequency should be maintained at a stable value (i.e., it should not be allowed to sweep down towards the normal operating frequency) while the lamp(s) are allowed to properly and fully ignite (which is accompanied by a corresponding reduction in the lamp impedance(s), and stabilization of the arc discharge in the lamp(s)); if the inverter operating frequency is not maintained (i.e., prevented from naturally decreasing) during that 100 millisecond period, inverter 200 may experience so-called "capacitive mode" operation, which is characterized by so-called "hard switching" of inverter transistors 210,220. Thus, microcontroller 720 serves the important function of providing the precise timing that is required for activating lamp stabilizing circuit 760, and then keeping circuit 760 activated, for a controlled period of time.

Applicable industry standards for instant start ballasts also dictate that, following ignition of the lamp(s), the lamp current must reach 90% of its rated operating current within 100 milliseconds. The control actions necessary to meet this standard, and as provided by ballast 20, again require precise timing control.

All of the previously described logic and timing functions are most advantageously realized, in a convenient and cost-effective manner, by employing a microcontroller 720 within control circuit 600. In view of the present lack of any commercially available control integrated circuit that is optimized for instant start applications, control circuit 600 thus provides a number of operational benefits that would otherwise be very difficult and/or costly to realize.

Referring again to FIG. 2, lamp status detection circuit 740 is coupled between resonant output circuit 400, voltage detection circuit 610, and input 722 of microcontroller 720. Lamp status detection circuit 740 may be realized by any of a number of structures that are known to those skilled in the art, such as by utilizing one or more RC networks (e.g., a resistor divider followed by a filter capacitor) to monitor the voltage at node 630 and the voltage across DC blocking capacitor 428. It should be understood that the voltage at node 630 is reflective of the voltage across output connections 402,404. During normal operation, after lamp 72 ignites, the voltage at node 630 decreases due to the "loading effect" of the ignited lamp. Conversely, the voltage at node 630 substantially increases under various fault conditions (e.g., if lamp 72 is removed, if arcing occurs at the sockets of the lamp fixture, and so forth).

During operation, lamp status detection circuit 740 monitors the voltage at node 630 and the voltage across DC blocking capacitor 428 for indications that a lamp fault condition (e.g., lamp removed or failed, diode mode lamp, etc.) has occurred. For example, as is known to those skilled in the art, a diode mode lamp fault condition is typically accompanied by the voltage across DC blocking capacitor 428 being substantially different from its normal operating value of about one-half of $+V_{RAIL}$; such a condition will be detected by lamp status detection circuit 740. If a lamp fault condition occurs, lamp status detection circuit 740 provides an appropriate voltage signal to input 722 of microcontroller 720. In response to that appropriate voltage signal being provided to input 722, microcontroller 420 provides an appropriate voltage signal (e.g., zero volts or so) at second output 728 for causing enable circuit 780 to turn off. Further details regarding the resulting operation of enable circuit 780 are discussed herein.

Lamp stabilization circuit 760 preferably comprises an electronic switch 762 and a zener diode 770. Electronic switch 762 is preferably realized as a NPN type bipolar junction transistor having a base 764, a collector 766, and an emitter 768. Base 764 of electronic switch 762 is coupled (via a resistor 730) to first output 726 of microcontroller 720. Emitter 768 of electronic switch 762 is coupled to circuit ground 60. Zener diode 770 has an anode 772 coupled to collector 766 of electronic switch 762, and a cathode 774 coupled to VCO input 234 of inverter driver circuit 230.

During operation, lamp stabilization circuit 760 is activated upon completion of the ignition period, and serves to prevent the operating frequency of inverter 200 from falling below a specified minimum value. More particularly, following completion of the predetermined period of time (during which time the operating frequency of inverter 200 is maintained at its present value, in order to attempt to ignite lamp 72), microcontroller 720 provides an appropriate voltage signal (e.g., several volts or so) at first output 726, thereby activating transistor 762. With transistor 762 turned on, the voltage at VCO input 234 of inverter driver circuit 230 is effectively clamped to about the zener breakdown voltage of zener diode 770. In this way, lamp stabilization circuit 760 serves to prevent capacitive-mode switching, or other undesirable effects, that might otherwise occur if the operating frequency of inverter 200 were allowed to decrease in an unrestricted manner following ignition of lamp 72.

Enable circuit 780 preferably comprises an electronic switch 782 that may be realized as a N-channel field-effect transistor (FET) having a gate 784, a drain 786, and a source 788. Gate 784 of FET 782 is coupled to second output 728 of microcontroller 720. Drain 786 of FET 782 is coupled to gate 252 of supply switch 250. Source 788 of FET 782 is coupled to circuit ground 60.

During normal operation (i.e., in the absence of a lamp fault condition), FET 782 is normally turned on, meaning that microcontroller 720 normally provides (via second output 728) a suitable voltage (e.g., +5 volts or so) for keeping FET 782 turned on. With FET 782 turned on, gate 252 of FET 250 is effectively coupled to ground via FET 782, thereby allowing FET 250 to remain turned on. With FET 250 turned on, operating current is continuously supplied to inverter driver circuit 230, and inverter 200 is allowed to continue to operate.

During abnormal operation (i.e., in response to a lamp fault condition, as indicated by, for example, an excessively high voltage at node 630 or an abnormal voltage across DC blocking capacitor 428), FET 782 is turned off by microcontroller 720 providing (via second output 728) a suitably low voltage (e.g., zero volts or so) for deactivating FET 782. With FET 782 turned off, FET 250 is correspondingly turned off. With FET 250 turned off, inverter driver circuit 230 is deprived of operating current and is correspondingly deactivated. With inverter driver circuit 230 being deactivated, inverter 200 ceases to operate, thereby preventing any damage (due to overvoltage and/or overcurrent and/or excessive power dissipation) to inverter 200 and/or output circuit 400 following occurrence of a lamp fault condition. In this way, lamp status detection circuit 740, microcontroller 720, enable circuit 780, and supply switch 250 function to ensure that ballast 20 is protected in the event of a lamp fault condition.

Ballast 20 thus provides an economical and reliable solution to the problem of igniting and operating a lamp in an instant start mode and with a topology that includes a series resonant output circuit. Ballast 20 accomplishes this by automatically compensating for parameter variations in the resonant output circuit (due to component tolerances and/or attributable to parasitic capacitances due to output wiring), thereby providing an appropriately high voltage for properly igniting lamp 72 in a manner that is reliable and that preserves the useful operating life of the lamp.

Figure 3:
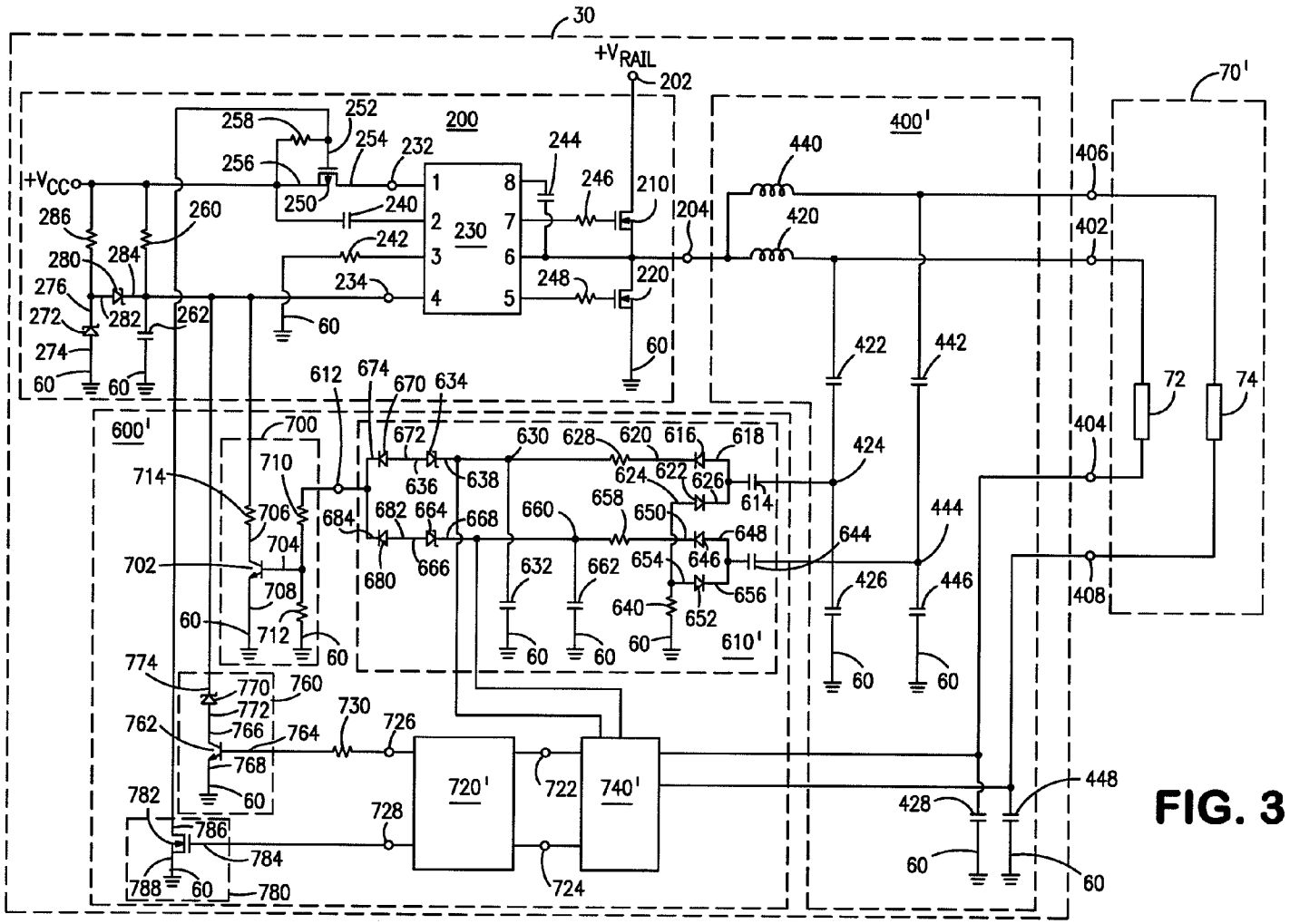
FIG. 3 is an electrical diagram of a ballast for powering two gas discharge lamps, in accordance with a second preferred embodiment of the present invention.

FIG. 3 describes a second preferred embodiment of ballast 10 (hereinafter referred to as ballast 30) that is configured for powering two gas discharge lamps 72,74 in an instant start mode of operation.

Although much of the preferred structure for ballast 30 is the same as that for ballast 20 (previously described with reference with FIG. 2), there are several pertinent differences. For instance, output circuit 400' includes two resonant circuits (one for each of lamps 72,74), and control circuit 600' includes two voltage detection circuits (one for each of the two resonant circuits). Additionally, the operation of control circuit 600' includes additional functions that are required and/or preferred in the context of a ballast for powering a lamp load that includes multiple lamps.

Referring to FIG. 3, a ballast 30 for powering a lamp load 70' that includes two gas discharge lamps 72,74 comprises an inverter 200, a resonant output circuit 400', and a control circuit 600'.

Inverter 200 is preferably realized with the same structure, and with the same operational features, as previously described with reference to FIGS. 1 and 2.

Resonant output circuit 400' is coupled between inverter output terminal 202 and lamp load 70. Resonant output circuit 400' includes a plurality of resonant circuits; in the context of the two-lamp embodiment described in FIG. 3, output circuit 400' includes a first resonant circuit (comprising resonant inductor 420, resonant capacitor 422, voltage-divider capacitor 426, and DC blocking capacitor 428), a second resonant circuit (comprising resonant inductor 440, resonant capacitor 442, voltage-divider capacitor 446, and DC blocking capacitor 448), and four output connections 402,404,406,408 that are adapted for coupling to a first lamp 72 and a second lamp 74. During operation, resonant output circuit 400' provides ignition voltages for igniting, and magnitude-limited currents for operating, lamps 72,74.

Control circuit 600' is coupled to inverter 200 and resonant output circuit 400'. During operation, control circuit 600' monitors a plurality of voltages within resonant output circuit 400'; in the context of the two-lamp embodiment illustrated in FIG. 3, control circuit 600' monitors a first voltage (i.e., the voltage at node 424) and a second voltage (i.e., the voltage at node 444) within resonant output circuit 400'. In response to the first of the monitored voltages (e.g., the voltage at node 424) reaching a specified level indicating that the ignition voltage for one of the lamps (e.g., lamp 72) is at an appropriately high magnitude for igniting that lamp, control circuit 600' directs inverter 200 to maintain its operating frequency at a first present value for a predetermined period of time. By maintaining the operating frequency at its present value, control circuit 600' allows the corresponding resonant circuit within output circuit 400' to maintain, for the predetermined period of time, the ignition voltage at a suitable level for igniting the first corresponding lamp (e.g., lamp 72). If the first corresponding lamp fails to ignite within the predetermined period of time, control circuit 600' deactivates inverter 200.

If the first corresponding lamp (e.g., lamp 72) ignites within the predetermined period of time, control circuit 600' does two things. First, control circuit 600' ceases controlling inverter 200 to maintain its operating frequency at the first present value (i.e., control circuit 600' allows the operating frequency to decrease below the first present value). Secondly, in response to the second of the monitored voltages (e.g., the voltage at node 444) reaching the specified level indicating that the ignition voltage for the other of the lamps (e.g., lamp 74) is at an appropriately high magnitude for igniting that lamp, control circuit 600' directs inverter 200 to maintain its operating frequency at a second present value for the predetermined period of time, so as to attempt to ignite the second corresponding lamp (e.g., lamp 74). If the second corresponding lamp fails to ignite within the predetermined period of time, control circuit 600' deactivates inverter 200. Conversely, if the second corresponding lamp does ignite within the predetermined period of time, control circuit 600' ceases controlling inverter 200 to maintain its operating frequency at the second present value (i.e., control circuit 600' allows the operating frequency to decrease below the second present value).

Control circuit 600' additionally provides a lamp stabilization period during which control circuit 600' prevents the operating frequency of inverter 200 from falling below a specified minimum value. By preventing the operating frequency from falling below of a specified minimum value, control circuit 600' prevents inverter 200 from operating in a so-called "capacitive switching mode," which is generally accompanied by undesirably high, and potentially destructive, levels of power dissipation in inverter transistors 210, 220.

Referring again to FIG. 3, output circuit 400' preferably comprises first and second output connections 402,404, third and fourth output connections 406,408, a first resonant circuit 420,422,426,428, and a second resonant circuit 440,442,446, 448. First and second output connections 402,404 are adapted for coupling to first lamp 72. Third and fourth output connections 406,408 are adapted for coupling to second lamp 74.

Within output circuit 400', the first resonant circuit comprises a first resonant inductor 420, a first resonant capacitor 422, a first voltage divider capacitor 426, and a first DC blocking capacitor 428. First resonant inductor 420 is coupled between inverter output terminal 204 and first output connection 402. First resonant capacitor 422 is coupled between first output connection 402 and a first node 424. First voltage divider capacitor 426 is coupled between first node 424 and circuit ground 60. First DC blocking capacitor 428 is coupled between second output connection 404 and circuit ground 60.

Within output circuit 400', the second resonant circuit comprises a second resonant inductor 440, a second resonant capacitor 442, a second voltage divider capacitor 446, and a second DC blocking capacitor 448. Second resonant inductor 440 is coupled between inverter output terminal 204 and third output connection 406. Second resonant capacitor 442 is coupled between third output connection 406 and a second node 444. Second voltage divider capacitor 426 is coupled between second node 444 and circuit ground 60. Second DC blocking capacitor 448 is coupled between fourth output connection 408 and circuit ground 60.

During operation of ballast 30, output circuit 400' receives the inverter output voltage (via inverter output terminal 204) and provides (via output connections 402,404,406,408) high voltages for igniting, and a magnitude-limited current for operating, lamps 72,74. For instance, when lamps 72,74 are realized as T8 type lamps, the high voltages for igniting lamps 72,74 are typically selected to be on the order of about 650 volts rms, and the magnitude-limited operating currents are typically selected to be on the order of about 180 milliamperes rms.

Under the approach that is commonly employed within many existing ballasts, in order to generate suitably high voltages for igniting lamps 72,74, the operating frequency of inverter 200 would ideally be set at or near the nominal natural resonant frequencies of the resonant circuits within resonant output circuit 400'. Unfortunately, in practice, the parameters which determine the natural resonant frequencies of the resonant circuits within output circuit 400' are subject to variation due to a number of factors, such as component tolerances (e.g., variations in the nominal inductance of resonant inductors 420,440 and the nominal capacitances of resonant capacitors 422,442) and parasitic capacitances attributable to the electrical wiring that connects output connections 402,404,406,408 to lamps 72,74. Such parameter variation makes it difficult to select the operating frequency of inverter 200, on an a priori basis, so as to ensure that suitably high ignition voltages are provided to both lamps 72,74.

The aforementioned difficulties due to parameter variation are especially problematic when resonant output circuit 400 includes multiple resonant circuits (as in the embodiment described in FIG. 3) and/or when the wiring between the ballast output connections and the lamp load has a considerable length (in which case the parasitic capacitance becomes a significant factor). With regard to multiple resonant circuits, it should be appreciated that, in practice, each of the multiple resonant circuits will almost certainly have at least slightly different resonant frequencies; consequently, the common approach of operating inverter 200 at a single predetermined frequency is generally not ideal for ensuring successful and proper ignition of multiple lamps.

Advantageously, ballast 30 resolves the aforementioned issues by actively monitoring the voltages at first node 424 and second node 444. It should be understood that: (i) the voltage at first node 424 is representative of the voltage that is provided between output connections 402,404, and is thus indicative of whether or not an appropriately high voltage is being provided for properly igniting first lamp 72; and (ii) the voltage at second node 444 is representative of the voltage that is provided between output connections 406,408, and is thus indicative of whether or not an appropriately high voltage is being provided for properly igniting second lamp 74.

As previously recited, following application of power to ballast 30 and startup of inverter 200, control circuit 600' allows the inverter operating frequency to decrease until at least such time as at least one of the monitored voltages (the voltage at first node 424 or the voltage at second node 444) reaches the specified level. Once that occurs, control circuit 600' maintains the operating frequency at its first present level (thereby maintaining the ignition voltage for the corresponding lamp at a sufficiently high level) for a predetermined period of time, so as to give the corresponding lamp a chance to ignite. Afterwards, provided that the first corresponding lamp has successfully ignited, control circuit 600' allows the operating frequency to decrease until at least such time as the second of the monitored voltages reaches the specified level. Once that occurs, control circuit 600' maintains the operating frequency at its second present level (thereby maintaining the ignition voltage for the second corresponding lamp at a sufficiently high level) for the predetermined period of time, so as to give the remaining lamp a chance to ignite. In this way, ballast 20 automatically compensates for any parameter variations within output circuit 400 (or due to wiring between the ballast output connections and the lamps), accounts for any parameter differences between multiple series resonant circuits, and thus ensures that suitably high voltages are provided for igniting lamps 72,74.

It will thus be appreciated by those skilled in the art that ballast 30 functions to effectively "seek out" suitable operating frequencies at which proper and successful ignition of the lamps can be achieved.

Preferred specific circuitry for implementing inverter 200 and control circuit 600' is now described with reference to FIG. 3. It is noted that the structure and operation of inverter 200 and control circuit 600' are largely identical that which was previously described with reference to the one-lamp ballast 20 illustrated in FIG. 2. It is also noted, however, that, within control circuit 600', voltage detection circuit 610' has a preferred structure and operation that is significantly more complex and extensive than that of detection circuit 610 (described in FIG. 2).

More particularly, with reference to FIG. 3, voltage detection circuit 610' comprises two portions. A first portion of voltage detection circuit 610' serves to monitor the voltage at node 424 (which is associated with the resonant circuit for first lamp 72), while a second portion of voltage detection circuit 610' serves to monitor the voltage at node 444 (which is associated with the resonant circuit for second lamp 74).

The first portion of voltage detection circuit 610' comprises a first coupling capacitor 614, a first diode 616, a second diode 622, a first low-pass filter 628,632, a first zener diode 634, and a third diode 670. First diode 616 has an anode 618 and a cathode 620. Second diode 622 has an anode 624 and a cathode 626. Anode 618 of first diode 616 is coupled to cathode 626 of second diode 622. Anode 624 of second diode 622 is operably coupled to circuit ground 60; however, as described in FIG. 3, it is preferred that anode 624 be coupled to circuit ground 60 by way of a current-limiting resistor 640. First coupling capacitor 614 is coupled between node 424 and anode 618 of first diode 616. The first low-pass filter comprises a series combination of a first filter resistor 628 and a first filter capacitor 632. First filter resistor 628 is coupled between cathode 620 of first diode 616 and a node 630. First filter capacitor 632 is coupled between node 630 and circuit ground 60. First zener diode 634 has an anode 636 and a cathode 638. Cathode 638 of first zener diode 634 is coupled to a junction (i.e., node 630) between first filter resistor 628 and first filter capacitor 632. Third diode 670 has an anode 672 and a cathode 674. Anode 672 of third diode 670 is coupled to anode 636 of first zener diode 634. Cathode 674 of third diode 670 is coupled to detection output 612.

The second portion of voltage detection circuit 610' comprises a second coupling capacitor 644, a fourth diode 646, a fifth diode 652, a second low-pass filter 658,662, a second zener diode 664, and a sixth diode 680. Fourth diode 646 has an anode 648 and a cathode 650. Fifth diode has an anode 654 and a cathode 656. Anode 648 of fourth diode 646 is coupled to cathode 656 of fifth diode 652. Anode 654 of fifth diode 652 is operably coupled to circuit ground 60; however, as described in FIG. 3, it is preferred that anode 654 be coupled to circuit ground 60 by way of current-limiting resistor 640. Second coupling capacitor 644 is coupled between node 444 and anode 648 of fourth diode 646. The second low-pass filter comprises a series combination of a second filter resistor 658 and a second filter capacitor 662. Second filter resistor 658 is coupled between cathode 650 of fourth diode 646 and a node 660. Second filter capacitor 662 is coupled between node 660 and circuit ground 60. Second zener diode 664 has an anode 666 and a cathode 668. Cathode 668 of second zener diode 664 is coupled to a junction (i.e., node 660) between second filter resistor 658 and second filter capacitor 662. Sixth diode 680 has an anode 682 and a cathode 684. Anode 682 of sixth diode 680 is coupled to anode 666 of second zener diode 664. Cathode 684 of sixth diode 680 is coupled to detection output 612.

During operation of voltage detection circuit 610', the voltages that develop across filter capacitors 632,662 are scaled-down and filtered versions of the positive half-cycles of the voltages at nodes 424,444. Coupling capacitors 614,644 serve to attenuate, while filter resistors 628,658 and filter capacitors 632,662 serve to suppress any high frequency components present in, the monitored voltages at nodes 424, 444.

In the first portion of voltage detection circuit 610', when the voltage at node 630 reaches the zener breakdown voltage of zener diode 634, zener diode 634 becomes conductive and provides, at detection output 612, a voltage signal which indicates that the voltage at first node 424 (i.e., the voltage across voltage-divider capacitor 426) has reached the specified level. Similarly, in the second portion of voltage detection circuit 610', when the voltage at node 660 reaches the zener breakdown voltage of zener diode 664, zener diode 664 becomes conductive and provides, at detection output 612, a voltage signal which indicates that the voltage at second node 444 (i.e., the voltage across voltage-divider capacitor 446) has reached the specified level. Thus, voltage detection circuit 610' operates to provide the voltage signal at detection 612 if either of the two monitored voltage within output circuit 400' has reached the predetermined level (indicating that sufficiently high ignition voltage is being provided to the associated lamp). In this way, voltage detection circuit 610' effectively monitors multiple voltages within output circuit 400'.

It will be appreciated that diodes 674,680 are preferably included in voltage detection circuit 610' in order to effectively isolate each of the two portions of voltage detection circuit 610' from each other. It is possible that, in the absence of diodes 674,680, the two portions of voltage detection circuit 610' may not function in the substantially independent manner as desired and as previously described.

As depicted in FIG. 3, lamp status detection circuit 740' preferably includes two additional inputs (i.e., one of which is coupled to node 660, and the other of which is coupled to DC blocking capacitor 448) in order to account for the fact that ballast 30 is adapted for powering two lamps (instead of only one lamp). Along similar lines, microcontroller 720' preferably includes one additional input 724. Apart from those differences, the preferred implementations and desired functions of microcontroller 720' and lamp status detection circuit 740' are essentially the same as those which were previously described, with reference to FIG. 2, regarding microcontroller 720 and lamp status detection circuit 740.

Ballast 30 thus provides an economical and reliable solution to the problem of igniting and operating two lamps, in an instant start mode, when each of the lamps has its own associated series resonant circuit. Ballast 30 accomplishes this by automatically compensating for parameter variations in the resonant output circuit (due to component tolerances and/or attributable to parasitic capacitances due to output wiring), thereby providing appropriately high voltages for properly igniting lamps 72,74 in a manner that it reliable and that preserves the useful operating lives of the lamps.

Although the present invention has been described with reference to certain preferred embodiments, numerous modifications and variations can be made by those skilled in the art without departing from the novel spirit and scope of this invention. For instance, although the specific preferred embodiments described herein are directed to ballasts for powering either one or two gas discharge lamps, it is contemplated that the principles of the present invention are readily adapted, with appropriate modifications to voltage detection circuit 610' and so forth, to ballasts for powering three or more lamps.

What is claimed is:

1. A ballast for powering at least one gas discharge lamp, the ballast comprising:

an inverter having an inverter output terminal and being operable to provide, at the inverter output terminal, an inverter output voltage having an operating frequency;

a resonant output circuit coupled between the inverter output terminal and the lamp, and operable to provide an ignition voltage for igniting the lamp;

a control circuit coupled to the output circuit and the inverter, wherein the control circuit is operable:

(a) to monitor a voltage within the resonant output circuit;

(b) in response to the monitored voltage reaching a specified level, to control the inverter to maintain its operating frequency at a present value for a predetermined period of time so as to allow the resonant output circuit to maintain, for the predetermined period of time, the ignition voltage at a suitable level for igniting the lamp;

(c) in response to ignition of the lamp within the predetermined period of time:

(i) to cease controlling the inverter to maintain its operating frequency at the present value, and (ii) during a lamp stabilization period, to prevent the operating frequency from falling below a specified minimum value; and (d) in response to failure of the lamp to ignite within the predetermined period of time, to deactivate the inverter.

2. The ballast of claim 1, wherein the resonant output circuit comprises a parallel-loaded series-resonant type output circuit.

3. The ballast of claim 2, wherein the resonant output circuit comprises:

first and second output connections adapted for coupling to a first lamp;

a resonant inductor coupled between the inverter output terminal and the first output connection;

a resonant capacitor coupled between the first output connection and a first node;

a voltage divider capacitor coupled between the first node and circuit ground; and a direct current (DC) blocking capacitor coupled between the second output connection and circuit ground.

4. The ballast of claim 1, wherein the inverter comprises:

an input for receiving a source of substantially direct current (DC) voltage;

an inverter output terminal;

at least a first inverter switch; and an inverter driver circuit coupled to at least the first inverter switch and operable to commutate the first inverter switch at the operating frequency, the inverter driver circuit comprising:

a DC supply input for receiving operating current from a DC voltage supply; and a voltage controlled oscillator (VCO) input, wherein the operating frequency is set in dependence upon a voltage provided to the VCO input.

5. The ballast of claim 4, wherein the inverter further comprises a supply switch having a gate, a source, and a drain, wherein the source is coupled to the DC voltage supply and the drain is coupled to the DC supply input of the inverter driver circuit.

6. The ballast of claim 4, wherein the inverter further comprises a frequency initializing circuit coupled between the DC supply voltage and the VCO input of the inverter driver circuit, wherein the frequency initializing circuit comprises:

a zener diode having an anode and a cathode, the anode being coupled to circuit ground;

a diode having an anode coupled to the cathode of the zener diode, and a cathode coupled to the VCO input of the inverter driver circuit; and a resistance coupled between the DC voltage supply and the cathode of the zener diode.

7. The ballast of claim 4, wherein the control circuit comprises:

a voltage detection circuit coupled to the resonant output circuit, and operable to provide a detection signal at a detection output in response to the monitored voltage within the resonant output circuit reaching the specified level; and a frequency-hold circuit coupled between the detection output of the voltage detection circuit and the VCO input of the inverter driver circuit, and operable, in response to the detection signal, to substantially maintain the voltage provided to the VCO input at a present level for the predetermined period of time.

8. The ballast of claim 7, wherein the voltage detection circuit comprises:

a first diode having an anode and a cathode;

a second diode having an anode and a cathode, wherein the anode of the first diode is coupled to the cathode of the second diode, and the anode of the second diode is operably coupled to circuit ground;

a coupling capacitor coupled between the resonant output circuit and the anode of the first diode;

a low-pass filter comprising a series combination of filter resistor and a filter capacitor, wherein the filter resistor is coupled to the cathode of the first diode and the series combination is coupled between the cathode of the first diode and circuit ground; and a zener diode having an anode and a cathode, wherein the anode is coupled to the detection output and the cathode is coupled to a junction between the filter resistor and the filter capacitor.

9. The ballast of claim 7, wherein the frequency-hold circuit comprises:

an electronic switch having a base, an emitter, and a collector, wherein the emitter is coupled to circuit ground;

a first biasing resistor coupled between the detection output of the voltage detection circuit and the base of the electronic switch;

a second biasing resistor coupled between the base of the electronic switch and circuit ground; and a pull-down resistor coupled between the VCO input of the inverter driver circuit and the collector of the electronic switch.

10. The ballast of claim 4, wherein:

the inverter further comprises a supply switch coupled between the DC voltage supply and the DC supply input of the inverter driver circuit; and the control circuit further comprises:

a microcontroller having at least one input and first and second outputs, wherein the microcontroller is operable to provide signals at the first and second outputs in dependence upon at least whether or not the at least one lamp has ignited within the predetermined ignition period;

a lamp status detection circuit coupled between the resonant output circuit and the at least one input of the microcontroller;

a lamp stabilization circuit coupled between the first output of the microcontroller and the VCO input of the inverter driver circuit, wherein the lamp stabilization circuit is operable, during the lamp stabilization period, to prevent the operating frequency from falling below the specified minimum value; and an enable circuit coupled between the second output of the microcontroller and to the supply switch, wherein the enable circuit is operable to render the supply switch non-conductive in response to a lamp fault condition.

11. The ballast of claim 10, wherein the lamp stabilization circuit comprises:

an electronic switch having a base, a collector, and an emitter, wherein the base is operably coupled to the first output of the microcontroller, and the emitter is coupled to circuit ground; and a zener diode having an anode coupled to the collector of the electronic switch, and a cathode coupled to the VCO input of the inverter driver circuit.

12. The ballast of claim 10, wherein the enable circuit comprises an electronic switch having a gate, a drain, and a source, wherein the gate is coupled to the second output of the microcontroller, the drain is coupled to the supply switch, and the source is coupled to circuit ground.

13. A ballast for powering at least one gas discharge lamp, the ballast comprising:

an inverter, comprising:

an input for receiving a source of substantially direct current (DC) voltage;

an inverter output terminal;

a first inverter switch coupled between the input and the inverter output terminal;

a second inverter switch coupled between the inverter output terminal and circuit ground; and an inverter driver circuit coupled to the first and second inverter switches and operable to commutate the first and second inverter switches at an operating frequency, wherein the inverter driver circuit comprises: (i) a DC supply input for receiving operating current from a DC voltage supply; and (ii) a voltage controlled oscillator (VCO) input, wherein the operating frequency is set in dependence upon a voltage at the VCO input;

a resonant output circuit coupled between the inverter output terminal and the lamp, and operable to provide an ignition voltage for igniting the lamp;

a control circuit coupled to the output circuit and the inverter, wherein the control circuit comprises:

a voltage detection circuit coupled to the resonant output circuit, and operable to provide a detection signal at a detection output in response to a monitored voltage within the resonant output circuit reaching a specified level, and a frequency-hold circuit coupled between the detection output of the voltage detection circuit and the VCO input of the inverter driver circuit, and operable, in response to the detection signal, to substantially maintain a voltage provided to the VCO input at a present level for a predetermined period of time;

a microcontroller having at least one input and a plurality of outputs, and operable to provide signals at the outputs in dependence upon at least whether or not the lamp has ignited within a predetermined ignition period;

a lamp status detection circuit coupled between the resonant output circuit and the at least one input of the microcontroller, and operable to monitor whether or not the lamp is ignited; and a lamp stabilization circuit coupled between a first output of the microcontroller and the VCO input of the inverter driver circuit, wherein the lamp stabilization circuit is operable, after completion of the predetermined ignition period, to prevent the operating frequency from falling below the specified minimum value.

14. The ballast of claim 13, wherein the resonant output circuit comprises:

first and second output connections adapted for coupling to a first lamp;

a resonant inductor coupled between the inverter output terminal and the first output connection;

a resonant capacitor coupled between the first output connection and a first node;

a voltage divider capacitor coupled between the first node and circuit ground; and a direct current (DC) blocking capacitor coupled between the second output connection and circuit ground.

15. The ballast of claim 13, wherein the inverter further comprises a frequency initializing circuit coupled between the DC supply voltage and the VCO input of the inverter driver circuit, the frequency initializing circuit comprising:

a zener diode having an anode and a cathode, the anode being coupled to circuit ground;

a diode having an anode coupled to the cathode of the zener diode, and a cathode coupled to the VCO input of the inverter driver circuit; and a resistance coupled between the DC voltage supply and the cathode of the zener diode.

16. The ballast of claim 13, wherein the voltage detection circuit comprises:

a first diode having an anode and a cathode;

a second diode having an anode and a cathode, wherein the anode of the first diode is coupled to the cathode of the second diode, and the anode of the second diode is operably coupled to circuit ground;

a coupling capacitor coupled between the resonant output circuit and the anode of the first diode;

a low-pass filter comprising a series combination of filter resistor and a filter capacitor, wherein the filter resistor is coupled to the cathode of the first diode and the series combination is coupled between the cathode of the first diode and circuit ground; and a zener diode having an anode and a cathode, wherein the anode is coupled to the detection output and the cathode is coupled to a junction between the filter resistor and the filter capacitor.

17. The ballast of claim 13, wherein the frequency-hold circuit comprises:

an electronic switch having a base, an emitter, and a collector, wherein the emitter is coupled to circuit ground;

a first biasing resistor coupled between the detection output of the voltage detection circuit and the base of the electronic switch;

a second biasing resistor coupled between the base of the electronic switch and circuit ground; and a pull-down resistor coupled between the VCO input of the inverter driver circuit and the collector of the electronic switch.

18. The ballast of claim 13, wherein the lamp stabilization circuit comprises:

an electronic switch having a base, a collector, and an emitter, wherein the base is operably coupled to the first output of the microcontroller, and the emitter is coupled to circuit ground; and a zener diode having an anode coupled to the collector of the electronic switch, and a cathode coupled to the VCO input of the inverter driver circuit.

19. The ballast of claim 13, wherein:

the inverter further comprises a supply switch coupled between the DC voltage supply and the DC supply input of the inverter driver circuit; and the control circuit further comprises an enable circuit coupled between a second output of the microcontroller and the supply switch, wherein the enable circuit comprises an electronic switch having a gate, a drain, and a source, wherein the gate is coupled to the second output of the microcontroller, the drain is coupled to the supply switch, and the source is coupled to circuit ground.

20. A ballast for powering a lamp load comprising a plurality of gas discharge lamps, the ballast comprising:

an inverter having an inverter output terminal and being operable to provide, at the inverter output terminal, an inverter output voltage having an operating frequency;

an output circuit coupled between the inverter and the lamp load, wherein the output circuit comprises a plurality of resonant circuits, wherein each of the resonant circuits is coupled between the inverter output terminal and a corresponding lamp within the lamp load and is operable to provide an ignition voltage for igniting the corresponding lamp;

a control circuit coupled to the inverter and to the output circuit, wherein the control circuit is operable:

(a) to monitor a plurality of voltages, the plurality of voltages comprising a monitored voltage within each of the resonant circuits;

(b) in response to a first of the monitored voltages reaching a specified level, to control the inverter to maintain its operating frequency at a first present value for a predetermined period of time so as to allow the first corresponding resonant circuit to maintain, for the predetermined period of time, its ignition voltage at a level suitable for igniting the first corresponding lamp;

(c) in response to failure of the first corresponding lamp to ignite within the predetermined period of time, to deactivate the inverter;

(d) in response to ignition of the first corresponding lamp within the predetermined period of time:

(i) to cease controlling the inverter to maintain its operating frequency at the first present value, thereby allowing the operating frequency to decrease from the first present value, and (ii) in response to a second of the monitored voltages reaching the specified level, to control the inverter to maintain its operating frequency at a second present value for the predetermined period of time so as to allow the second corresponding resonant circuit to maintain, for the predetermined period of time, the ignition voltage at a level suitable for igniting the second corresponding lamp;

(e) in response to failure of the second corresponding lamp to ignite with the predetermined period of time, to deactivate the inverter; and (f) in response to ignition of the second corresponding lamp within the predetermined period of time, to cease controlling the inverter to maintain its operating frequency at the second present value, thereby allowing the operating frequency to decrease from the second present value.

21. The ballast of claim 20, wherein the control circuit is further operable to prevent the operating frequency from falling below a specified minimum value.

22. The ballast of claim 20, wherein the output circuit comprises:

first and second output connections adapted for coupling to a first lamp;

third and fourth output connections adapted for coupling to a second lamp;

a first resonant circuit, comprising:

a first resonant inductor coupled between the inverter output terminal and the first output connection;

a first resonant capacitor coupled between the first output connection and a first node;

a first voltage divider capacitor coupled between the first node and circuit ground; and a first direct current (DC) blocking capacitor coupled between the second output connection and circuit ground; and a second resonant circuit, comprising:

a second resonant inductor coupled between the inverter output terminal and the third output connection;

a second resonant capacitor coupled between the third output connection and a second node;

a second voltage divider capacitor coupled between the second node and circuit ground; and a second direct current (DC) blocking capacitor coupled between the fourth output connection and circuit ground.

23. The ballast of claim 20, wherein the inverter comprises:

an input for receiving a source of substantially direct current (DC) voltage;

an inverter output terminal;

at least a first inverter switch; and an inverter driver circuit coupled to at least the first inverter switch and operable to commutate the first inverter switch at the operating frequency, the inverter driver circuit comprising:

a DC supply input for receiving operating current from a DC voltage supply; and a voltage controlled oscillator (VCO) input, wherein the operating frequency is set in dependence upon a voltage provided to the VCO input.

24. The ballast of claim 23, wherein the inverter further comprises a supply switch coupled between the DC voltage supply and the DC supply input of the inverter driver circuit, wherein the supply switch includes a gate, a source, and a drain, wherein the source is coupled to the DC voltage supply and the drain is coupled to the DC supply input of the inverter driver circuit.

25. The ballast of claim 23, wherein the inverter further comprises a frequency initializing circuit coupled between the DC supply voltage and the VCO input of the inverter driver circuit, the frequency initializing circuit comprising:

a zener diode having an anode and a cathode, the anode being coupled to circuit ground;

a diode having an anode coupled to the cathode of the zener diode, and a cathode coupled to the VCO input of the inverter driver circuit; and a resistance coupled between the DC voltage supply and the cathode of the zener diode.

26. The ballast of claim 23, wherein the control circuit further comprises:

a voltage detection circuit coupled to the first and second resonant circuits of the output circuit, wherein the voltage detection circuit includes a detection output and is operable to provide a detection signal at the detection output in response to at least one of the first monitored voltage and the second monitored voltage reaching the specified level; and a frequency-hold circuit coupled between the common detection output of the voltage detection circuits and the VCO input of the inverter driver circuit, and operable, in response to the detection signal, to substantially maintain the voltage provided to the VCO input at a present level for at least one of the first predetermined period of time and the second predetermined period of time.

27. The ballast of claim 26, wherein the voltage detection circuit comprises:

a first diode having an anode and a cathode;

a second diode having an anode and a cathode, wherein the anode of the first diode is coupled to the cathode of the second diode, and the anode of the second diode is operably coupled to circuit ground;

a first coupling capacitor coupled between the first resonant circuit and the anode of the first diode;

a first low-pass filter comprising a series combination of a first filter resistor and a first filter capacitor, wherein the first filter resistor is coupled to the cathode of the first diode and the series combination is coupled between the cathode of the first diode and circuit ground;

a first zener diode having an anode and a cathode, wherein the cathode is coupled to a junction between the first filter resistor and the first filter capacitor; and a third diode having an anode and a cathode, wherein the anode is coupled to the anode of the first zener diode and the cathode is coupled to the detection output; and a fourth diode having an anode and a cathode;

a fifth diode having an anode and a cathode, wherein the anode of the fourth diode is coupled to the cathode of the fifth diode, and the anode of the fifth diode is operably coupled to circuit ground;

a second coupling capacitor coupled between the second resonant circuit and the anode of the fourth diode;

a second low-pass filter comprising a series combination of a second filter resistor and a second filter capacitor, wherein the second filter resistor is coupled to the cathode of the fourth diode and the series combination is coupled between the cathode of the fourth diode and circuit ground;

a second zener diode having an anode and a cathode, wherein the cathode is coupled to a junction between the second filter resistor and the second filter capacitor; and a sixth diode having an anode and a cathode, wherein the anode is coupled to the anode of the second zener diode and the cathode is coupled to the detection output.

28. The ballast of claim 26, wherein the frequency-hold circuit comprises:

an electronic switch having a base, an emitter, and a collector, wherein the emitter is coupled to circuit ground;

a first biasing resistor coupled between the detection output of the voltage detection circuit and the base of the electronic switch;

a second biasing resistor coupled between the base of the electronic switch and circuit ground; and a pull-down resistor coupled between the VCO input of the inverter driver circuit and the collector of the electronic switch.

29. The ballast of claim 23, wherein:

the inverter further comprises a supply switch coupled between the DC voltage supply and the DC supply input of the inverter driver circuit; and the control circuit further comprises:

a microcontroller having at least one input and first and second outputs, wherein the microcontroller is operable to provide signals at the first and second outputs in dependence upon at least whether or not both the first lamp and the second lamp have ignited within an allotted time period;

a lamp status detection circuit coupled between the first and second resonant circuit and the at least one input of the microcontroller;

a lamp stabilization circuit coupled between the first output of the microcontroller and the VCO input of the inverter driver circuit, wherein the lamp stabilization circuit is operable, during the lamp stabilization period, to prevent the operating frequency from falling below the specified minimum value; and an enable circuit coupled between the second output of the microcontroller and to the supply switch, wherein the enable circuit is operable to render the supply switch non-conductive in response to a lamp fault condition.

30. The ballast of claim 29, wherein:

the lamp stabilization circuit comprises:

an electronic switch having a base, a collector, and an emitter, wherein the base is operably coupled to the first output of the microcontroller, and the emitter is coupled to circuit ground; and a zener diode having an anode coupled to the collector of the electronic switch, and a cathode coupled to the VCO input of the inverter driver circuit; and the enable circuit comprises an electronic switch having a gate, a drain, and a source, wherein the gate is coupled to the second output of the microcontroller, the drain is coupled to the supply switch, and the source is coupled to circuit ground.

* * * * *